US005542521A

United States Patent [19]

Meyer et al.

[11] Patent Number: 5,542,521

[45] Date of Patent: Aug. 6, 1996

[54] STEP PLATFORM FOR AN ESCALATOR

[75] Inventors: Helmut J. W. Meyer, Bueckeburg; Hermann W. Ahls, Obernkirchen OT Vehlen; Klaus Blaseck, Burgdorf-Ehlershausen; Udo Schmitting, Schwafoerden, all of Germany

[73] Assignee: Otis Elevator Company, Farmington, Conn.

[21] Appl. No.: 318,305

[22] Filed: Oct. 5, 1994

[51] Int. Cl.[6] ..... B66B 29/08

[52] U.S. Cl. ..... 198/324; 198/333

[58] Field of Search ..... 198/321, 324, 198/333

[56] References Cited

U.S. PATENT DOCUMENTS

| | | | |
|---|---|---|---|
| 4,557,369 | 12/1985 | Ishida et al. | 198/333 |
| 4,681,207 | 7/1987 | Goto et al. | 198/333 |
| 5,332,077 | 7/1994 | Ogimura | 198/324 X |
| 5,435,428 | 7/1995 | Adachi et al. | 198/324 |

FOREIGN PATENT DOCUMENTS

| | | |
|---|---|---|
| 0132335 | 1/1985 | European Pat. Off. . |
| 2259068 | 3/1993 | United Kingdom . |
| 2263461 | 7/1993 | United Kingdom . |

*Primary Examiner*—D. Glenn Dayoan

[57] ABSTRACT

A step platform for an escalator is provided, comprising a higher step and a lower step. The higher step includes a top surface and a support arm. The lower step has a main body, a raisable middle section, and apparatus for selectively raising the middle section. When the apparatus for selectively raising the middle section engages the support arms, the top surface of the middle section is maintained in the same plane as the top surface of the higher step.

15 Claims, 7 Drawing Sheets

STEP PLATFORM FOR AN ESCALATOR

TECHNICAL FIELD

This invention relates to escalators in general, and to step platforms for escalators in particular.

BACKGROUND ART

Escalators and elevators are two of the most popular means for moving pedestrian traffic from a first elevation to a second elevation. Elevators are typically used when the rise is greater than two floors, and the passenger volume light to moderate. Escalators, in contrast, are typically used when the rise is three floors or less and the passenger volume moderate to heavy. Despite each means targeting a different need, it is very common today for existing buildings to have both escalators and elevators, thereby capitalizing on the advantages of both.

Historically, handicapped pedestrian traffic has been limited to elevators because of the inability of escalators to accept handicapped passengers, in particular those in wheelchairs. Handicap access in existing buildings has been provided, therefore, by having either elevators alone or both escalators and elevators. Today, however, the trend in almost all types of buildings is towards less expensive two and three story buildings which can be operated more efficiently. The cost of installation and maintenance, coupled with the unrentable occupied space, make providing both escalators and elevators a less popular option than in the past. Passenger traffic and handicap access must still be satisfied, however.

DISCLOSURE OF THE INVENTION

It is, therefore, an object of the present invention to provide a step platform for an escalator which makes the escalator handicapped accessible.

It is a further object of the present invention to provide a step platform for an escalator which is an integral part of the escalator, and therefore located at the escalator at all times.

It is a still further object of the present invention to provide a step platform for an escalator which can be retracted when not in use, thereby allowing-the escalator to operate in a normal mode.

It is a still further object of the present invention to provide a step platform for an escalator which may be retrofit on to existing escalators.

According to the present invention, a step platform for an escalator is provided, comprising a higher step and a lower step. The higher step includes a top surface and a support arm. The lower step comprises a main body, a raisable middle section, and means for selectively raising the middle section. When the means for selectively raising the middle section engages the support arms, the top surface of the middle section is maintained in the same plane as the top surface of the higher step.

According to one aspect of the present invention, a wheel chock and means for selectively operating the wheel chock are provided attached to the raisable middle section of the lower step.

An advantage of the present invention is that the present invention provides a step platform which enables handicapped passengers to utilize an escalator.

A further advantage of the present invention is that the present invention provides a step platform that is an integral part of the escalator. As a result, all the equipment that is necessary to utilize the step platform is present at the escalator. In some prior art wheelchair accessible escalators, an external piece of equipment is necessary to utilize the step platform and, therefore, may or may not be accessible at the moment desired.

A still further advantage of the present invention is that the step platform may be installed as a retrofit on existing escalator units.

These and other objects, features and advantages of the present invention will become more apparent in light of the detailed description of the best mode embodiment, thereof, as illustrated in the accompanying drawings.

DETAILED DESCRIPTION OF THE DRAWINGS

BEST MODE FOR CARRYING OUT THE INVENTION

I. Environment

Figure 1:
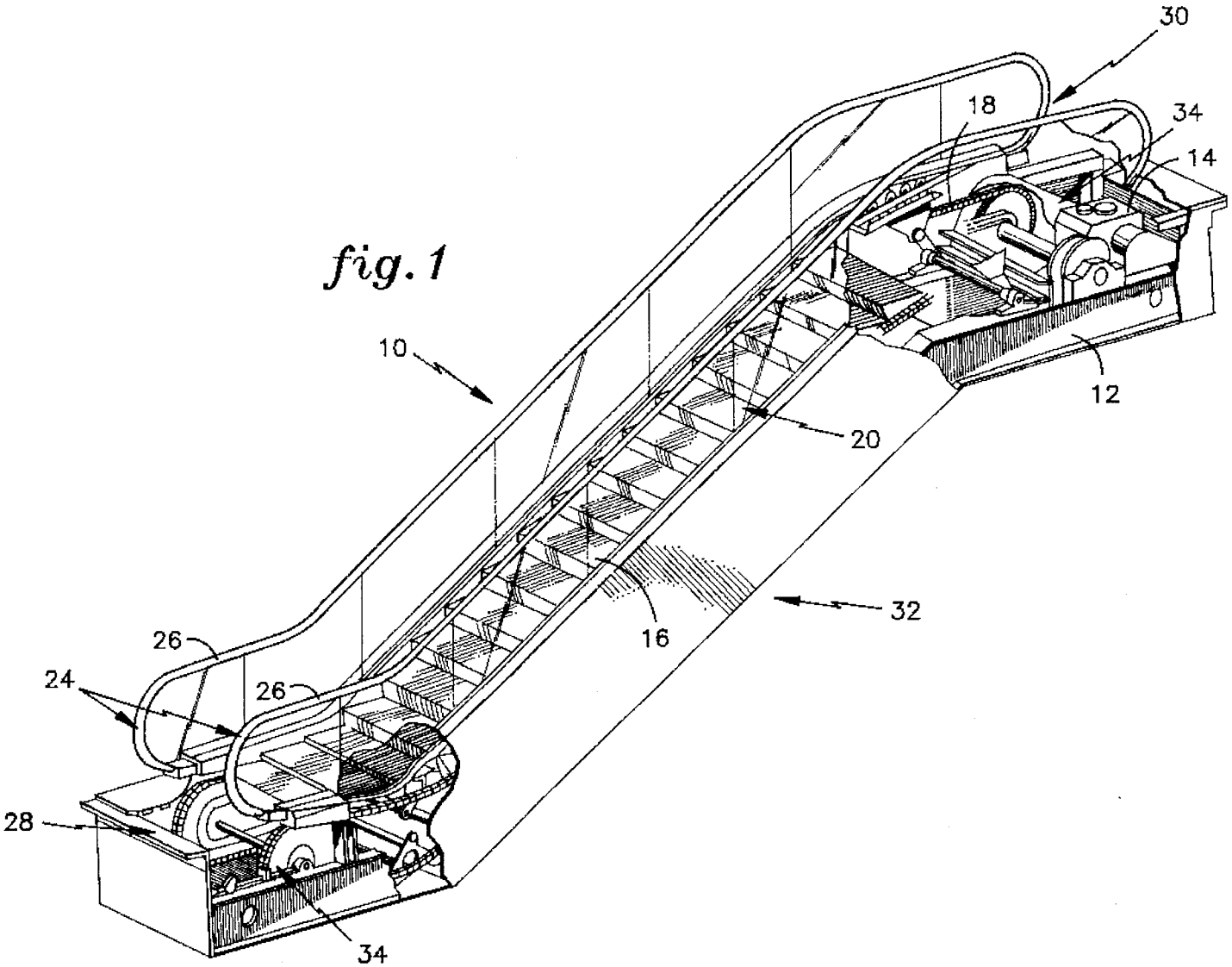
FIG. 1 is a diagrammatic view of an escalator having a step platform.

Now referring to FIG. 1, an escalator 10 utilizing the step platform 20 of the present invention, is shown having a frame 12, a drive 14, a plurality of steps 16 attached to a step chain 18, and a pair of balustrades 24 for guiding a pair of handrails 26. The frame 12 includes a lower landing 28, an upper landing 30, and an inclined midsection 32 therebetween. The step chain 18, comprising two strands connected by connecting axles as is known in the art, travels a circuitous path within the frame 12, reversing direction around a sprocket assembly 34 in each landing 28,30. Each step 16 is pivotly attached to a connecting axle and includes rollers (shown in FIGS. 2A and 2B) for contact with a pair of roller tracks (not shown) fixed to the frame 12.

Figure 2A:
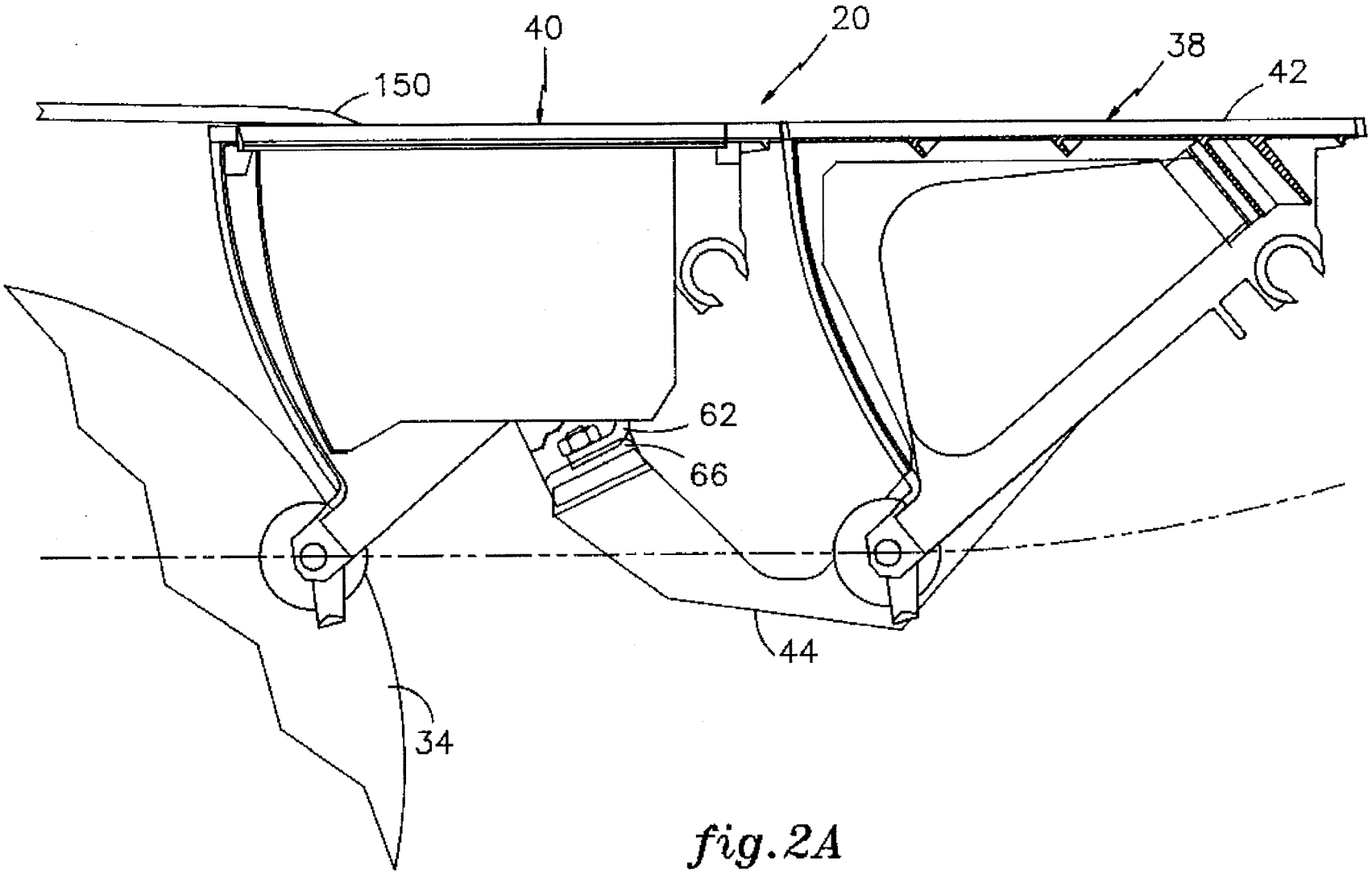
FIG. 2A is a diagrammatic view of the step platform shown in FIG. 1, positioned in a landing.

Referring to FIG. 2A, the step platform 20 includes a higher step 38 and a lower step 40, adjacent one another. The higher step 38 comprises a top surface 42 and a pair of support arms 44. Each support arm 44 is fixed to the higher step 38 below the top surface 42. The support arms 44 extend out from beneath the higher step 38 and continue under the lower step 40. A person of skill in the art will recognize that one or more than two support arms may be used alternatively.

Figure 3:
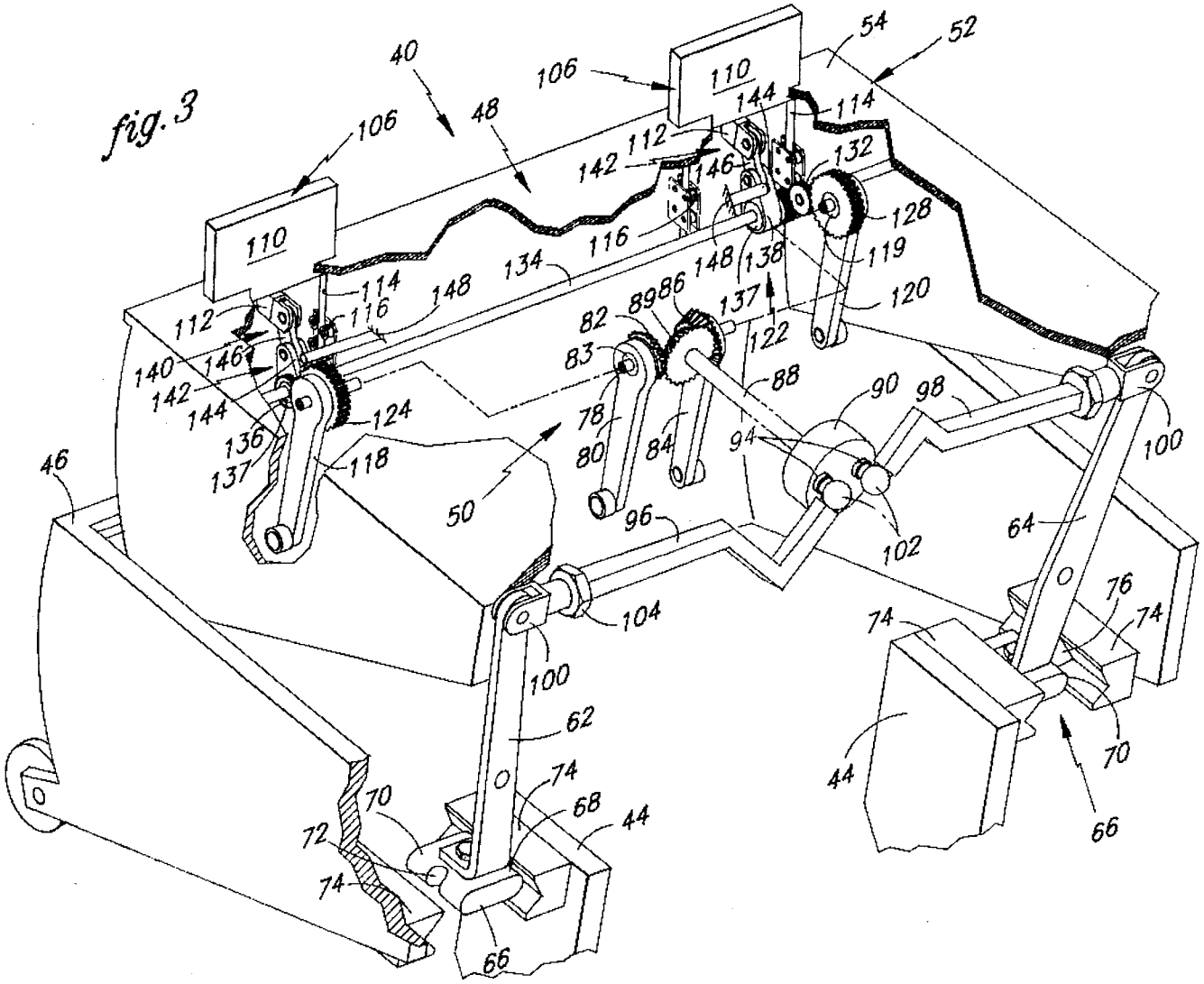
FIG. 3 is an exploded perspective view of the lower step of the step platform.

Referring to FIG. 3, the lower step 40 of the step platform 20 includes a main body 46, a raisable middle section 48 received within the main body 46, means 50 for selectively raising the middle section 48, a pair of wheel chocks 106, and means 108 for selectively operating the wheel chocks 106. The middle section 48 comprises an upper panel 52 having a top surface 54.

The means 50 for selectively raising the middle section 48 includes a pair of engagement arms 62,64, a pair of shafts 78,88, a first and second trip arm 80,84, a first, second, and third bevel gear 82,86,89, and a pair of adjustable rods 96,98. The reader is further directed to FIGS.4A and 4B which show a part of this arrangement from a planar, two dimensional view.

The engagement arms 62,64 are pivotly mounted on the middle section 48. One end of each engagement arm 62,64 includes a base 66 having inside 68 and outside 70 male extensions. Each male extension 68,70 comprises a slot 72, or other lateral locating means. Channels 74 are attached to both the support arms 44 and the main body 46 of the lower step 40 for receiving the male extensions 68,70. The channels 74 include cylindrical bosses 76 which correspond with the slots 72 in the male extensions 68,70, or other lateral locating means.

Referring to FIG. 3, the first shaft 78 is mounted on the middle section 48. The first 80 and second 84 trip arms are pivotly mounted on the first shaft 78 by bearings 83. The first and second bevel gears 82,86 are attached to the first and second trip arms 80,84 respectively, spaced apart and facing each other. The second shaft 88 is pivotly mounted on the middle section 48 with the third bevel gear 89 attached to one end and a flange 90 attached to the other end. The third bevel gear 89 is in mesh with both the first 82 and second 86 bevel gears. The flange 90 includes two holes 94.

Figure 4A:
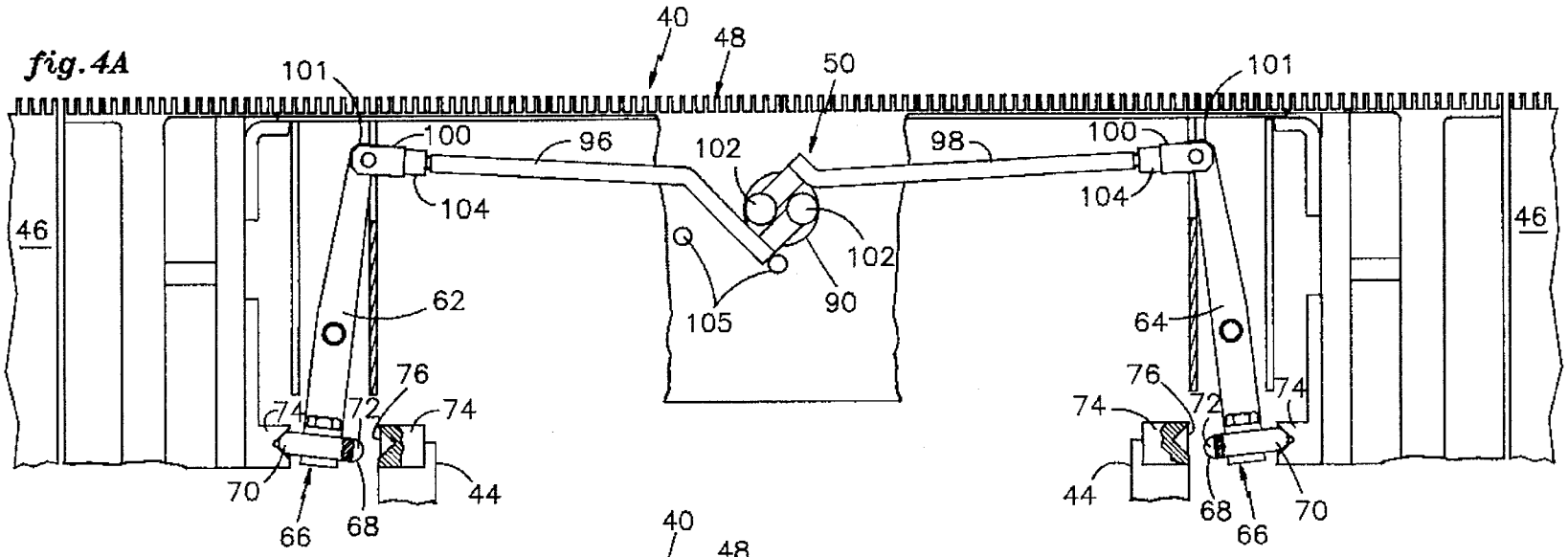
FIG. 4A is a diagrammatic partial view of the lower step of the step platform in the normal mode of operation.
Figure 4B:
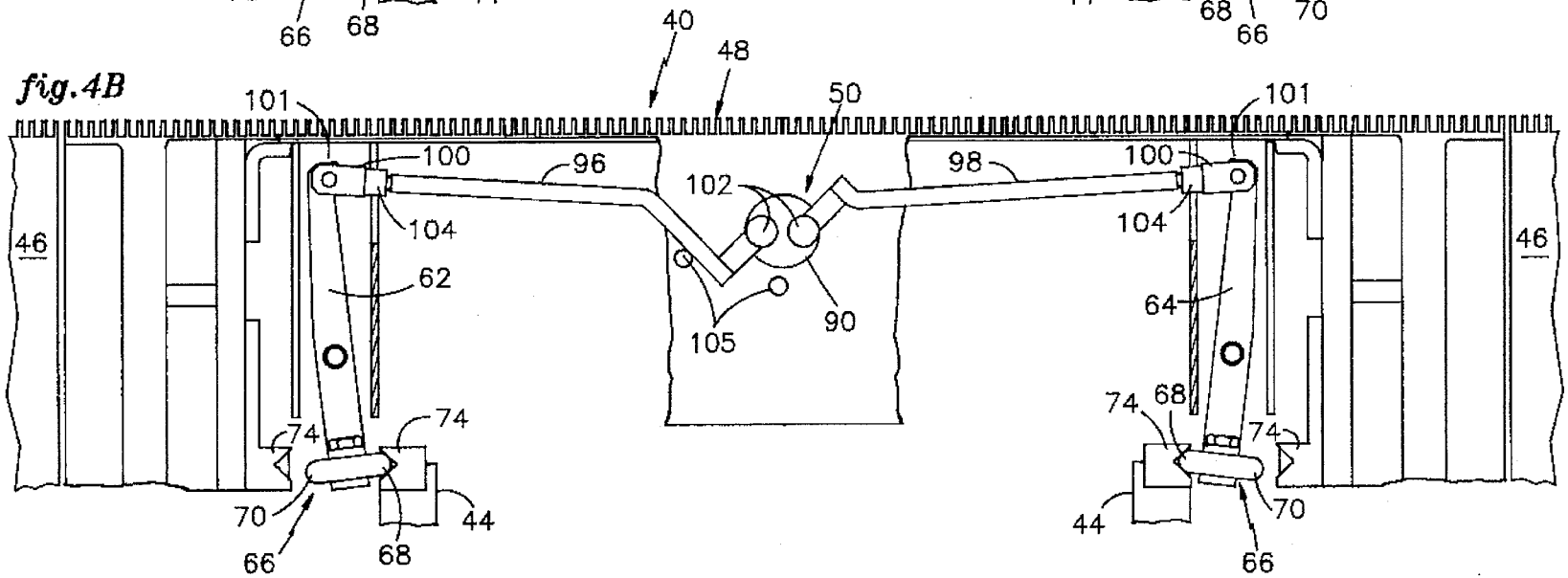
FIG. 4B is a diagrammatic partial view of the lower step of the step platform, with the step platform in operation.

Referring to FIG. 4A and 4B, each adjustable rod 96,98 includes a rod end 100 adjustably threaded into one end, and a pin 102 (see FIG. 3) attached to the other end. The rod end 100 includes a lock nut 104, or other locking means, for fixing the position of the rod end 100 relative to the adjustable rod 96,98. Each rod end 100 is pivotly attached to one of the engagement arms 62,64, on the end 101 of the engagement arm opposite the base 66. Each pin 102 is conventionally attached to pivot within the flange 90 which is attached to the second shaft 88 (see FIG. 3).

Stops 105, attached to the middle section 48, prevent the flange 90 and attached adjustable rods 96,98 from rotating past a first and second detent position. The first detent position is located at five degrees of rotation past the greatest lateral extension of the adjustable rods 96,98 and the second detent position is located at five degrees of rotation past the least lateral extension of the adjustable rods 96,98. A person of ordinary skill in the art will recognize positions other than five degrees past the greatest and least extension points may be chosen alternatively.

Referring to FIG. 3, the wheel chocks 106 each comprise a stopping surface 110, a flange 112 attached to the stopping surface 110, and a pair of guide rods 114. A pair of roller assemblies 116, attached to the middle section 48, receive and direct the guide rods 114 of each wheel chock 106 within the middle section 48.

The means 108 for selectively operating the wheel chocks 106, comprises a third trip arm 118, a fourth trip arm 120, and an actuation mechanism 122. The third 118 and fourth 120 arms are pivotly mounted on the first shaft 78 by bearings 119.

The actuation mechanism 122 includes a first gear 124 attached to the third trip arm 118, a second gear 128 attached to the fourth trip arm 120, an intermediate gear 132, a third shaft 134, a third gear 136, a fourth gear 138, and means 140 for registering the wheel chocks 106 with the third 136 and fourth 138 gears.

The third 136 and fourth 138 gears are fixed to the third shaft 134 by keys 137. The third shaft 134, in turn, is pivotly attached to the middle section 48 parallel to the first shaft 78. The first gear 124 is in mesh with the third gear 136 and the second gear 128 is in mesh with the intermediate gear 132, which is, in turn, in mesh with the fourth gear 138. Rotating the third trip arm 118 in a clockwise direction, therefore, causes the third 136 and fourth 138 gears, the third shaft 134, the second gear 128 and the fourth trip arm 120 to rotate in a counterclockwise direction. The intermediate gear 132, in mesh between the fourth gear 138 and the second gear 128, rotates in a clockwise direction.

The means 140 for registering the wheel chocks 106 with the third 136 and fourth 138 gears comprises a pair of cranks 142. Each crank comprises a first link 144 and a second link 146. One end of each first link 144 is fixed to the third shaft 134. The other end of each first link 144 is pivotly attached to one end of a second link 146. The other end of each second link 146 is pivotly attached to the flange 112 attached to the stopping surface 110 of each wheel chock 106. Stops 148 are provided adjacent the cranks 142 to prevent the cranks 142 from rotating past a third detent position. Stops may also be provided by positioning any of the mechanical hardware adjacent the cranks in a position which would allow it to act as a stop in addition to its other function. The third detent position is located at five degrees of rotation past the greatest extension of the wheel chocks 106. A person of ordinary skill in the art will recognize that the third detent position may be located at a position past the greatest extension of the wheel chocks 106, other than five degrees.

A person of ordinary skill in the art will recognize that the means 140 for registering the wheel chocks 106 with the third 136 and fourth gears 138 may alternatively take the form of a pair of toothed racks (not shown) in register with the third 136 and fourth 138 gears. Moreover, both chocks 106 may be connected together, or a single chock may be chosen, and operated by a single means for registering the wheel chocks 106 with the third 136 and fourth 138 gears; i.e. one crank only, or one toothed rack only.

II. Operation

Referring to FIG. 1, in the operation of the escalator 10, the step chain 18 and attached steps 16 travel circuitously from the lower landing 28, up the inclined midsection 32, through the upper landing 30 and back down to the lower landing 28. In the lower landing 28, the step chain 18 and attached steps 16 change direction around a sprocket assembly 34 and subsequently travel out from underneath a combplate 150 (see FIG. 2A). Underneath the combplate 150 and for a distance thereafter, the roller tracks (not shown) of the escalator 10 maintain the top surfaces of the steps 16 in a single level plane.

a. Normal Mode of Operation

In the normal mode of operation, it is known when each step 16 begins to enter the inclined midsection 32 from the lower landing 28, the angle of the roller track causes each step 16 to rise above the step 16 behind it. When the angle of the roller track becomes constant within the inclined midsection 32, all of the steps 16 within the inclined midsection 32 are maintained at a similar difference in height by the roller tracks. As each step 16 enters the upper landing 30, the process reverses and the steps 16 return to having their top surfaces in the same plane as one another.

Subsequently, the steps 16 rotate around the sprocket assembly 34 in the upper landing 30 and return towards the lower landing 28.

Referring to FIG. 4A, in this mode of operation, the middle section 48 of the lower step 40 of the step platform 20 (see FIGS. 2A and 2B) is maintained within the main body 46 of the lower step 40 by the means 50 for selectively raising the middle section 48. Specifically, the adjustable rods 96,98 are held in the second detent position, i.e. five degrees past the point of least lateral extension of the adjustable rods 96,98, thereby causing the base 66 of each engagement arm 62,64 to be engaged with the main body 46 of the lower step 40. When the base 66 of each engagement arm 62,64 is engaged with the main body 46, the outside male extension 70 is received within the channel 74 attached to the main body 46 of the lower step 40. The cylindrical boss 76 extending out within the channel 74 and the slot 72 within the extension 70, locate the male extension 70 within the channel 74 and prevent relative motion between the two. The second detent position locks the engagement arms 62,64 in this position because movement of the engagement arms 62,64 forces the flange 90 to rotate either back through the point of least extension, or into one of the stops 105 located adjacent the flange 90.

Figure 2B:
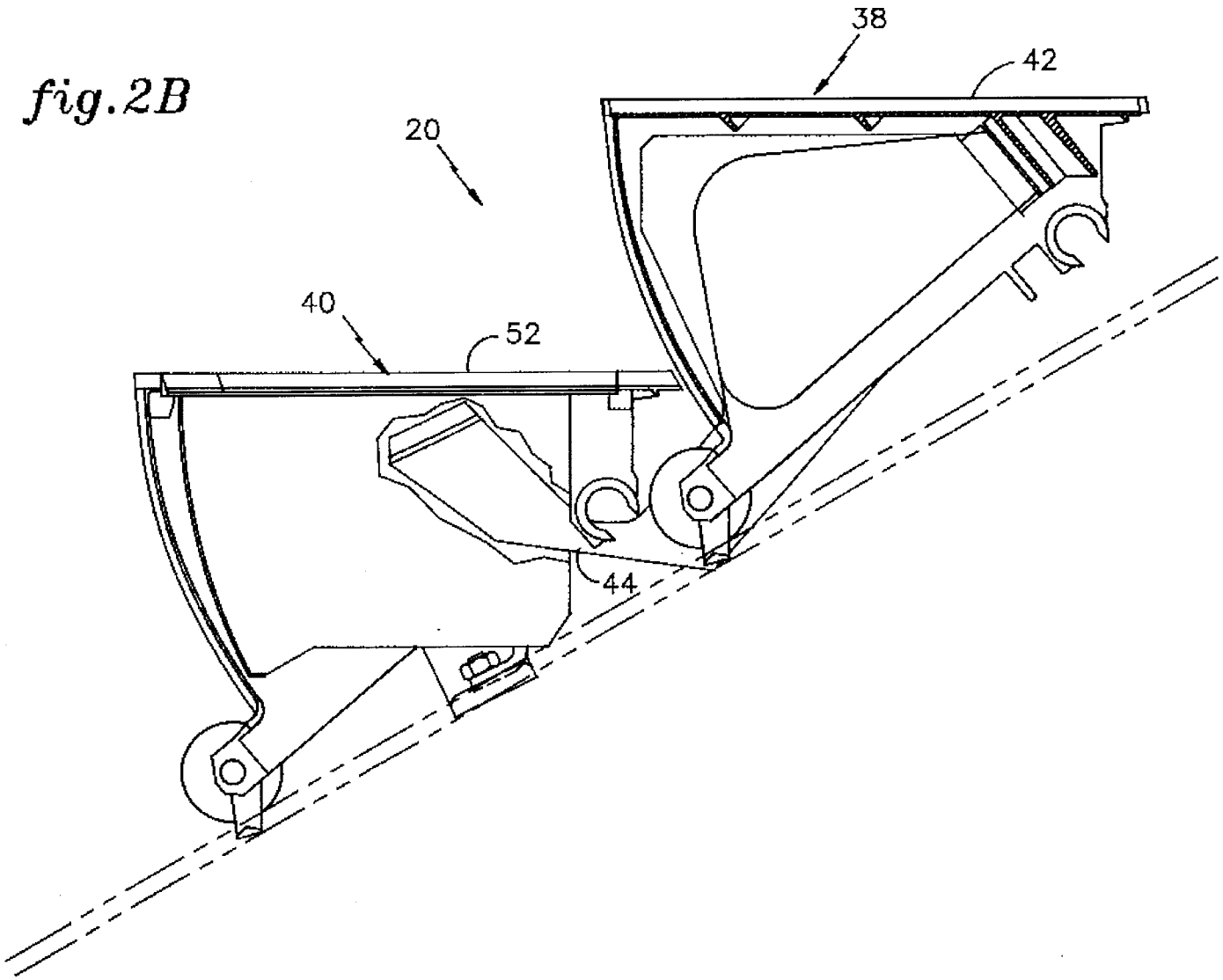
FIG. 2B is a diagrammatic view of the step platform in its normal mode of operation, as shown in FIG. 1, positioned in the inclined midsection.

Referring to FIG. 2B, as the higher step 38 enters the inclined midsection 32 (before the lower step 40), the support arms 44 of the higher step 38 move upward within the middle section 48 of the lower step 40. The support arms 44 move past the bases 66 of the engagement arms 62,64 and approach the upper panel 52 of the middle section 48. In this position, the support arms 44 are not coupled with the middle section 48 of the lower step 40. As a result, the top surface 54 of the middle section 48 remains in the same plane as the top of the lower step 40.

b. Operation of the Step Platform

Figure 5:
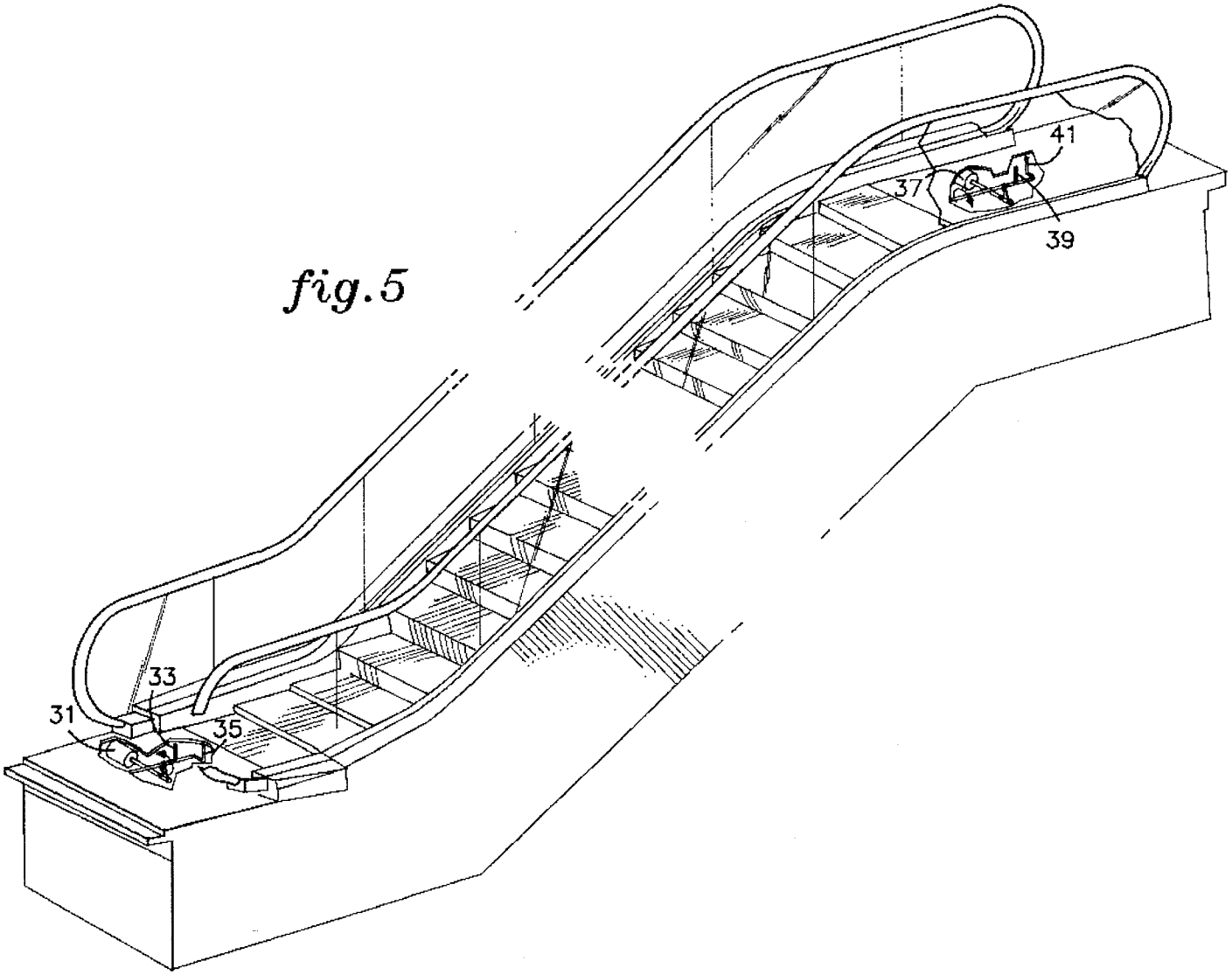
FIG. 5 is a diagrammatic view of the escalator shown in FIG. 1, illustrating the solenoids and mechanical structures in both landings.

Referring to FIGS. 1 and 3, when a passenger requires the step platform 20 while traveling from the lower landing 28 to the upper landing 30, he or she or an attendant, pushes a call button or switch (not shown). The call button signals a first solenoid 31 (see FIG. 5) positioned within the lower landing 28 to actuate a first mechanical structure 33 into the path of the second trip arm 84. The structure 33 contacts and rotates the second trip arm 84 and attached second bevel gear 86 about the first shaft 78 as the lower step 40 travels by. The rotating second bevel gear 86, in turn, causes the third bevel gear 89 and second shaft 88, and first bevel gear 82 and first trip arm 80 to rotate. When the second shaft 88 rotates, the adjustable rods 96,98 pivotly attached to the flange 90 extend outwardly and pivot the engagement arms 62,64 (see FIG. 4B). A person of ordinary skill in the art will recognize that the amount of lateral travel of the adjustable rods 96,98 may be adjusted by changing the position of the rod ends 100 relative to the adjustable rods 96,98. The lock nut 104 fixes the position of the rod end 100 relative to the adjustable rod 96,98.

Referring to FIG. 4B, the rotating trip arm 84 causes flange 90 to rotate until stop 105 is contacted at the first detent position. In the first detent position, the inside male extension 68 of each base 66 is received within a channel 74 fixed to the support arms 44 of the higher step 38 (see FIG. 2A). The slot 72 in the inside male extension 68 receives the cylindrical boss 76 fixed within the channel 74, thereby locating the extension 68 within the adjacent channel 74 and preventing relative motion between the two. The first detent position maintains the engagement arms 62,64 in this position because movement of the engagement arms 62,64 forces the flange 90 to rotate either back through the point of greatest lateral extension of the adjustable rods 96,98 or into one of the stops 105 adjacent the flange 90.

Figure 2C:
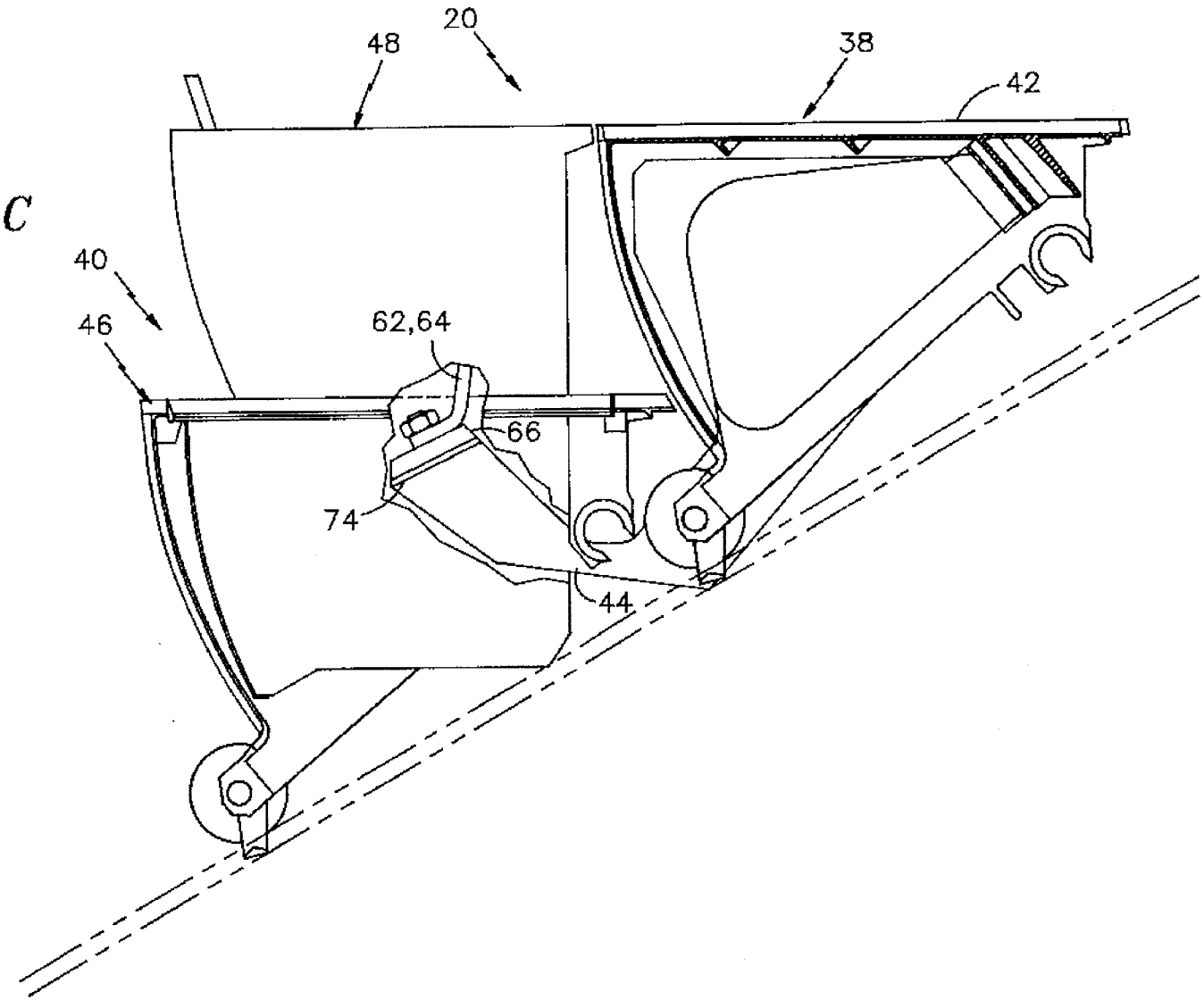
FIG. 2C is a diagrammatic view of the step platform of FIG. 1, shown in operation within the inclined midsection.

Referring to FIGS. 2C and 4B, support for the middle section 48 of the lower step 40 transfers from the main body 46 of the lower step 40 to the support arms 44 of the higher step 38 when the bases 66 of the engagement arms 62,64 are pivoted from engagement with the channels 74 in the main body 46 to engagement with the channels 74 in the support arms 44. The transfer of support occurs in the lower landing 28 (see FIG. 1).

Referring to FIGS. 1 and 3, before the step platform 20 travels from the lower landing 28 to the inclined midsection 32, but after the lower step 40 has emerged from under the combplate 150, the first solenoid 31 (see FIG. 5) actuates a second mechanical structure 35 into the path of the fourth trip arm 120. Specifically, the structure 35 contacts and rotates the fourth trip arm 120 in a clockwise direction. As a result, the third 136 and fourth 138 gears, the third shaft 134, the first link 144, the intermediate gear 132, and the third trip arm 118 all rotate in a counterclockwise direction.

The stopping surfaces 110 of the wheel chocks 106 extend above the top surface 54 of the middle section 48 of the lower step 40 when the first links 144 are rotated clockwise. The guide rods 114 and roller assemblies 116 guide and facilitate the movement of the wheel chocks 106.

The cranks 142 are rotated past the point of greatest extension of the wheel chocks 106 and into contact with stops 148 adjacent the cranks 142. Stops may also be provided by positioning any of the mechanical hardware adjacent the cranks in a position which would allow it to act as a stop in addition to its other function. The third detent position maintains the wheel chocks 106 in this position because the cranks 142 must be either rotated through the point of greatest extension of the wheel chocks 106 or into contact with the stops 148 adjacent the cranks 142. The cranks 142 are rotated into the third detent position while the step platform 20 is in the lower landing 28, before the first 38 and second 40 step have entered the inclined midsection 32.

When the step platform 20 has reached the upper landing 30, the operation of the step platform 20 is reversed. Specifically, as the platform 20 enters the upper landing 30 and the higher and lower steps are level again, a second solenoid 37 (see FIG. 5) actuates a third mechanical structure 39, into the path of the first trip arm 80. The structure 39 contacts the first trip arm 80 and forces it to rotate clockwise. The first trip arm 80, in turn, rotates the third bevel gear 89 and second shaft 88, and the second bevel gear 86 and second trip arm 84 to their original position. The adjustable rods 96,98 attached to the flange 90 are likewise returned to the second detent position and the engagement arms 62,64 are reengaged with the main body 46 of the lower step 40.

The second solenoid 37 (see FIG. 5) subsequently actuates a fourth mechanical structure 41, into the path of the third trip arm 118, thereby causing the third trip arm 118 to rotate. As a result, the third 136 and fourth 138 gears, the third shaft 134, the first links 144, the second gear 128 and attached fourth trip arm 120 all rotate back to their original position. The wheel chocks 106 retract within the middle section 48 of the lower step 40 as the cranks 142 rotate.

A person of ordinary skill in the art will recognize that the solenoids 33,37 described heretofore are employed as a means for actuating a mechanical device in the path of the trip arms 80,84,118,120. Accordingly, a variety of actuating devices such as pneumatic or hydraulic cylinders, or electric drives, may be used.

A person of ordinary skill in the art will further recognize that the choice of rotating the trip arms 80,84,118,120 clockwise or counterclockwise is arbitrary, and depends on where the trip arms are located relative to the means for actuating them.

Moreover, reversing the travel of the escalator 10 from the described ascent up the inclined midsection 32, to traveling down the inclined midsection 32, requires that the timing of the solenoids be changed relative to the implementation of the wheel chocks 106 and the middle section 48 of the lower step 40.

Although this invention has been shown and described with respect to the detailed embodiments thereof, it will be understood by those skilled in the art that various changes in form and detail thereof may be made without departing from the spirit and scope of the claimed invention.

We claim:

1. A step platform for an escalator having a first landing, a second landing, and an inclined section therebetween, comprising:

a higher step, having a top and a support arm;

a lower step, comprising a main body;

a raisable middle section, having a top; and means for selectively raising said middle section, thereby maintaining said top of said middle section in the same plane as the top of said higher step;

wherein said support arm extends out from beneath said higher step and continues under said lower step to support passenger loads on said middle section when raised.

2. A step platform for an escalator according to claim 1, wherein said means for selectively raising said middle section, comprises:

an engagement arm, pivotly mounted on said middle section; and means for selectively pivoting said engagement arm into engagement with one of said main body or said support arm of said higher step.

3. A step platform for an escalator according to claim 1, wherein said means for selectively raising said middle section, comprises:

a first engagement arm, pivotly mounted on said middle section;

a second engagement arm, pivotly mounted on said middle section; and means for selectively pivoting said engagement arms into engagement with one of said main body or said support arm of said higher step.

4. A step platform for an escalator according to claim 3, wherein said means for selectively pivoting said engagement arms comprises:

a first shaft, mounted on said middle section;

a first trip arm, having a first bevel gear, pivotly mounted on said first shaft;

a second trip arm, having a second bevel gear, pivotly mounted on said first shaft;

a second shaft, pivotly mounted on said middle section, having a third bevel gear and a flange fixed thereto, wherein said third bevel gear meshes with both said first and second bevel gears;

a first adjustable rod, pivotly attached to said first engagement arm and said flange; and a second adjustable rod, pivotly attached to said second engagement arm and said flange;

wherein rotating said first trip arm and attached first bevel gear in a clockwise or counterclockwise direction causes said third bevel gear to rotate, said third bevel gear in turn causing said second bevel gear and attached second trip arm to rotate in the other of said clockwise or said counterclockwise direction;

wherein rotating said third bevel gear causes said flange to rotate, thereby causing said adjustable rods to pivot said engagement arms into engagement with one of said main body or said support arm of said higher step.

5. A step platform for an escalator according to claim 4, wherein said means for selectively pivoting said arms further comprises:

means for stopping the rotation of said flange in a first detent position, past the point of greatest lateral extension of said adjustable shafts;

means for stopping the rotation of said flange in a second detent position, past the point of least lateral extension of said adjustable shafts.

6. A step platform for an escalator according to claim 1, further comprising:

a wheel chock;

means for selectively operating said wheel chock above said top of said middle section or retracting said wheel chock within said middle section.

7. A step platform for an escalator according to claim 6, wherein said means for selectively operating said wheel chock above said top of said middle section or retracting said wheel chock within said middle section, comprises:

means for guiding said wheel chock;

a third trip arm, pivotly mounted on said first shaft;

a fourth trip arm, pivotly mounted on said first shaft; and means for actuating said wheel chock, wherein rotating one of said third or fourth trip arms in a clockwise or a counterclockwise direction causes said wheel chock to extend above said top of said middle section, and causes the other of said third or fourth trip arms to rotate in the other of said clockwise or counterclockwise direction, and further wherein rotating said trip arms in the opposite direction causes said wheel chock to retract within said middle section.

8. A step platform for an escalator according to claim 7, wherein said means for actuating said wheel chock, comprises:

a first gear, attached to said third trip arm, pivotly mounted on said first shaft;

a second gear, attached to said fourth trip arm, pivotly mounted on said first shaft;

an intermediate gear, mounted to said middle section, in mesh with said second gear;

a third shaft, pivotly mounted to said middle section;

a third gear, fixed to said third shaft, in mesh with said first gear;

a fourth gear, fixed to said third shaft, in mesh with said intermediate gear;

means for registering said wheel chock with said third and fourth gears;

wherein rotating said third trip arm and attached first gear in either a clockwise or a counterclockwise direction causes said first gear to rotate said third and fourth gears, said third shaft, said second gear, and fourth trip arm in the other of said clockwise or counterclockwise direction, and causes said registering means to either retract said wheel chocks within said middle step, or extend said wheel chocks above the top surface of said middle step.

9. A step platform for an escalator according to claim 8, wherein said registering means comprises:

a crank, having a first link fixed to said third shaft, and a second link pivotly attached to both said first link and said wheel chock;

wherein rotating said third shaft causes said first link to rotate in a first direction and said second link in a second direction, thereby moving said wheel chock.

10. A step platform for an escalator according to claim 9, wherein said registering means further comprises:

means for stopping the rotation of said crank;

wherein said crank may be rotated into a detent position for maintaining the position of said wheel chocks.

11. A step platform for an escalator according to claim 4, further comprising:

a wheel chock;

means for selectively operating said wheel chock above said top of said middle section or retracting said wheel chock within said middle section.

12. A step platform for an escalator according to claim 11, wherein said means for selectively operating said wheel chock above said top of said middle section or retracting said wheel chock within said middle section, comprises:

means for guiding said wheel chock;

a third trip arm, pivotly mounted on said first shaft;

a fourth trip arm, pivotly mounted on said first shaft; and means for actuating said wheel chock, wherein rotating one of said third or fourth trip arms in a clockwise or a counterclockwise direction causes said wheel chock to extend above said top of said middle section, and causes the other of said third or fourth trip arms to rotate in the other of said clockwise or counterclockwise direction, and further wherein rotating said trip arms in the opposite direction causes said wheel chock to retract within said middle section.

13. A step platform for an escalator according to claim 12, wherein said means for actuating said wheel chock, comprises:

a first gear, attached to said third trip arm, pivotly mounted on said first shaft;

a second gear, attached to said fourth trip arm, pivotly mounted on said first shaft;

an intermediate gear, mounted to said middle section, in mesh with said second gear;

a third shaft, pivotly mounted to said middle section;

a third gear, fixed to said third shaft, in mesh with said first gear;

a fourth gear, fixed to said third shaft, in mesh with said intermediate gear;

means for registering said wheel chock with said third and fourth gears;

wherein rotating said third trip arm and attached first gear in either a clockwise or a counterclockwise direction causes said first gear to rotate said third and fourth gears, said third shaft, said second gear, and fourth trip arm in the other of said clockwise or counterclockwise direction, and causes said registering means to either retract said wheel chocks within said middle step, or extend said wheel chocks above the top surface of said middle step.

14. A step platform for an escalator according to claim 13, wherein said registering means comprises:

a crank, having a first link fixed to said third shaft, and a second link pivotly attached to both said first link and said wheel chock;

wherein rotating said third shaft causes said first link to rotate in a first direction and said second link in a second direction, thereby moving said wheel chock.

15. A step platform for an escalator according to claim 14, wherein said registering means further comprises:

means for stopping the rotation of said crank;

wherein said crank may be rotated into a detent position for maintaining the position of said wheel chocks.

* * * * *